US006430795B1

(12) United States Patent
Sawdon et al.

(10) Patent No.: US 6,430,795 B1
(45) Date of Patent: Aug. 13, 2002

(54) COMPOSITE URETHANE STRIPPER FOR METAL JOINING APPARATUS

(75) Inventors: Edwin G. Sawdon, St. Clair; Steven J. Sprotberry, Marysville, both of MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 09/707,258

(22) Filed: Nov. 6, 2000

(51) Int. Cl.[7] ..... B23P 11/00
(52) U.S. Cl. ..... 29/243.5; 29/509
(58) Field of Search ..... 29/509, 243.5, 29/243.52, 243.53, 283.5, 21.1, 522.1, 527.1, 505, 798, 569

(56) References Cited

U.S. PATENT DOCUMENTS

| | | | | |
|---|---|---|---|---|
| 3,579,809 A | * | 5/1971 | Wolf | 29/509 |
| 5,315,743 A | * | 5/1994 | Schleicher | 29/243.5 |
| 5,709,019 A | * | 1/1998 | Sawdon | 29/243.5 |

* cited by examiner

*Primary Examiner*—Joseph J. Hail, III
*Assistant Examiner*—Daniel Shanley
(74) *Attorney, Agent, or Firm*—Harness, Dickey & Pierce

(57) ABSTRACT

A composite stripper for use in conjunction with an apparatus for joining multiple pieces of sheet metal or other sheet material is disclosed. The composite stripper is an elongated cylindrical member having a compliant midsection which is compressible to clamp sheet materials tightly together and a pair of relatively hard end portions and to provide an adequate interface between the punch assembly and the material to be joined.

20 Claims, 1 Drawing Sheet

COMPOSITE URETHANE STRIPPER FOR METAL JOINING APPARATUS

BACKGROUND AND SUMMARY OF THE INVENTION

The present invention relates generally to joining sheet material, and more particularly to a molded stripper for use in the joining apparatus to form leak-proof or non-leak-proofjoints.

The ability to permanently join multiple pieces of sheet material through punching or other manipulation and deforming them into an interlocking relationship has found widespread applications. In this regard, such method and apparatuses for permanently joining sheet metal or other sheet material items, with the capability of forming either leak-proof joints or conventional "lanced joints" has been the subject of numerous patents. Such apparatuses include die members that are movable laterally, transverse to the longitudinal movement of a punch against an anvil between the dies which are relatively simple but durable in construction, which utilize standard or specialized punches, which are compact and suitable in many different applications, which preserve the corrosive resistance of coated sheet material being joined, and which are suitable for use either in a small press or in a C-frame holder of a large press. In this regard, U.S. Pat. No. 5,581,860 and the related U.S. patents identified therein are exemplary of this technology. The disclosure of all such patent applications and issued U.S. patents are expressly incorporated by reference herein.

In pertinent part to the present invention, U.S. Pat. No. 5,581,860 discloses a punch assembly having a punch body mounting a circular punch. The circular punch includes a threaded portion which receives and threadingly supports a stripper retainer. Disposed within the stripper retainer is a stripper or sheet metal retainer biased to a stripping position by means of a coil spring. The stripper serves to clamp sheet material together before and during the formation of the joint. The stripper preferably has an outside diameter at the area of longitudinal engagement with the sheet metal to be formed that is greater than the inside diameter of the die opening when the dies are at their maximum laterally outward open position. This, coupled with biasing forces urging the stripper longitudinally against the sheet metal surrounding the joint in order to clamp the sheet metal pieces together, greatly reduces the tendency for the sheet material to flow longitudinally outward, away from the preferably fixed anvil inside of the die opening.

The coil spring used to generate the stripper biasing force has a tendency to degrade during repeated cycling. More specifically, the clamping forces generated by the stripper decrease as the stripper is repeatedly cycled, and may ultimately fail in a fatigue mode. Likewise, the metal tip of the stripper which contact the sheet material may scratch or mar the material being stripped. Although the prior art strippers perform satisfactorily, the present application is directed to additional improvements and refinements thereupon.

In accordance with the present invention, as defined in the appended claims, a composite urethane stripper is provided for use in conjunction with various punch assemblies to provide sufficient force to clamp the sheet materials tightly together before and during the forming of the joint. As presently preferred, the composite stripper utilizes two components of urethane having different hardness—a pair of end portions utilizing a relatively hard durometer urethane and a middle portion utilizing a relatively soft durometer urethane. The configuration of the stripper is such that the clamping force may be accurately and repeatedly controlled.

These features, along with others discussed in more detail below provide a stripper for use in die assemblies of forming apparatuses that are more durable and reliable, more versatile, more stable, more widely applicable, and that typically require less maintenance to operate than previous strippers.

These and other objects, features and advantages of the present invention will become apparent from the subsequent description and the appended claims, taking in conjunction with the accompanying drawings.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
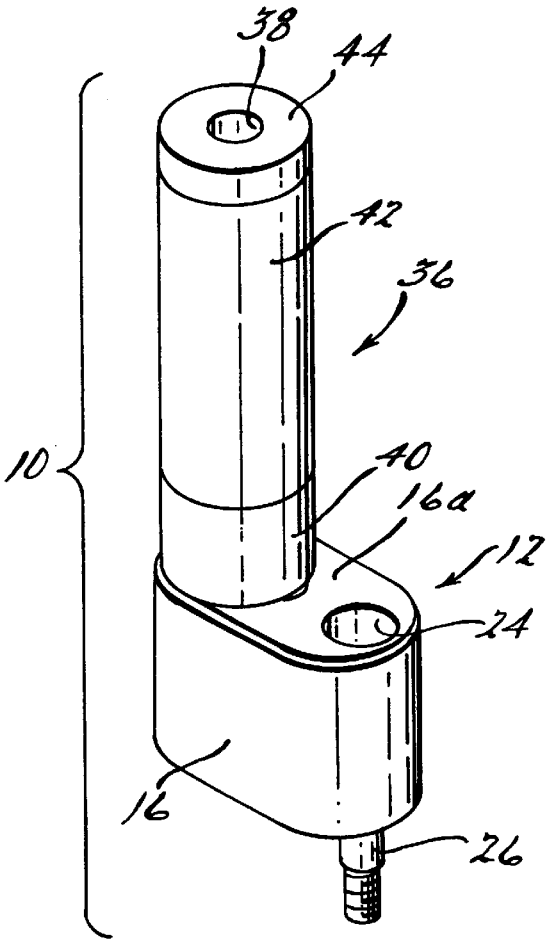
FIG. 1 is a perspective view of a punch assembly having a molded composite urethane stripper.
Figure 2:
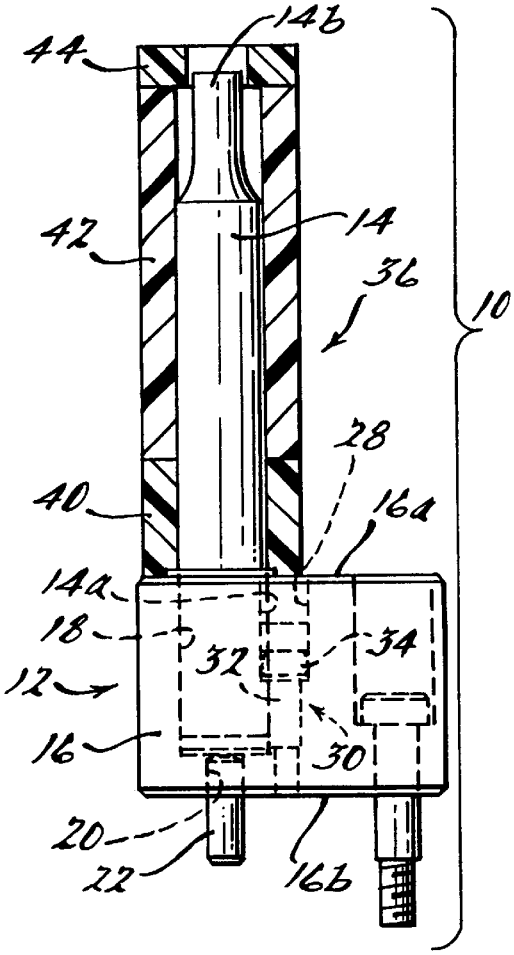
FIG. 2 is a cross-section of a punch assembly taken along line II—II shown in FIG. 1.

With reference to the figures, punch assembly 10 includes punch holder 12 having punch 14 extending from body 16. More specifically, as best seen in FIG. 2, blind bore 18 extends into body 16 from an upper surface 16*a* thereof and is adapted to received punch 14. Throughbore 20 is axially aligned with and extends into blind bore 18 from a lower surface 16*b* of body 16 and is adapted to receive locating pin 22. A second throughbore 24 is formed in body 16 and is adapted to received socket head cap screw 26. In this manner, punch assembly 10 may be releasably secured to a movable die (not shown) of a joint forming apparatus.

Body 16 further includes throughbore 28 extending therethrough to receive retainer assembly 30 for releasably securing punch 14 within punch holder 12. More specifically, retainer assembly 30 includes bolt 32 and retaining washer 34 received within throughbore 28. Retainer washer 34 is threadedly secured within throughbore 28. As retaining bolt 32 is tightened down, retaining washer 34 engages a shoulder portion 14*a* of punch 14, thereby releasably securing punch 14 within punch holder 12.

Figure 3:
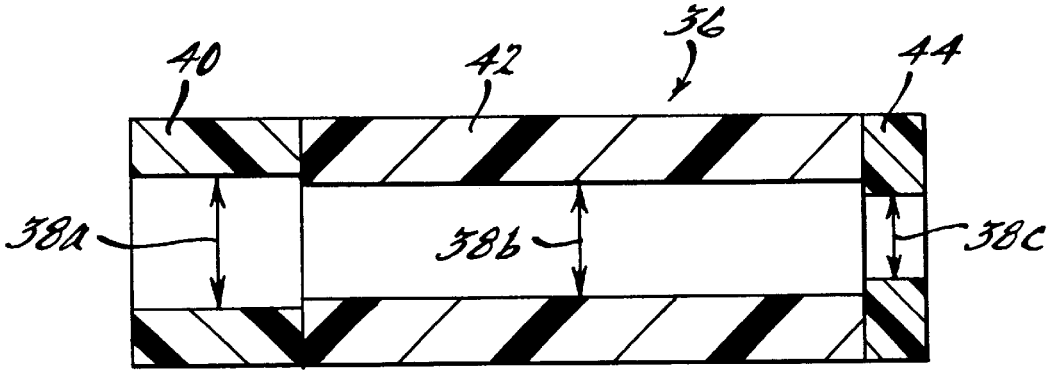
FIG. 3 is a cross-sectional view of molded composite urethane stripper.

Composite stripper 36 is an elongated cylindrical member having a longitudinal bore 38 formed therethrough which is adapted to receive punch 14. Composite stripper 36 includes base section 40, middle spring section 42 and tip section 44. As best seen in FIG. 3, the inside diameter of bore 38 varies through base section 40, middle section 42 and top section 44. More specifically, the inside diameter 38*b* of middle section 42 is slightly less than the outside diameter of punch 14, and therefore is used to retain stripper 36 on the shank of punch 14 by a slight "press" or interference fit. The inside diameter 38a of base portion 40 is slightly larger than the outside diameter of punch 14 to provide a clearance for the shank of punch 14. Similarly, the inside diameter 38*c* of tip portion 44 is slightly larger than the outside diameter of the tip 14*a* of punch 14 to provide a slight clearance around the tip 14*b* of punch 14. The portion of throughbore 38*a*, 38*c* associated with base portion 40 and tip portion 44 may be molded or machined to suit the specific geometric shape of punch 14.

As presently preferred, stripper 36 is of a composite construction in that it incorporates materials of varying hardness for achieving different functional features. As presently preferred, base portion 40 and tip portion 44 are made from a relatively hard durometer urethane, preferably of a hardness of approximately 75D, to provide proper support and wear characteristics, while middle portion 42 is made from a relatively soft durometer urethane, preferably of a hardness of approximately 95A, to control the overall clamping force generated when the composite stripper 36 is compressed. More specifically, the hard urethane on base portion 40 prevents extrusion of composite stripper 36 into any adjacent hole, such as throughbore 28 of punch holder 12. This eliminates the need for a metal washer supporting composite stripper 36. Utilizing hard urethane for tip portion 44 resists marring the material being stripped, a problem commonly encountered in the use of standard metal stripper tips. Furthermore, utilizing a relatively hard urethane tip minimizes the wear on composite stripper 36 associated with the repeated cycling during the adjoining operation. The use of a softer durometer urethane for middle section 42 provides sufficient compliance to generate the compression force necessary to adequately hold and clamp the material being joined. This gives a reliable stripping force with a consistent range of compression. Middle portion 42 and tip portion 44 of composite stripper 36 are preferably of a constant length regardless of the length of the punch used. In contrast, the length of base portion 40 may be modified to provide a desired overall length of composite stripper 36.

Composite stripper 36 may be fabricated using a sequential process molding tip portion 44, middle portion 42 and the base part 40. Alternately, composite stripper may be fabricated by placing base portion 40 and tip portion 44 into a suitable mold and injection molding middle portion 42 in a manner sufficient to bond base and tip portions 40, 44 thereto. One skilled in the art will also recognize that other molding processes may be adapted for a given composite stripper configuration. Furthermore, colors may be utilized in the fabrication of composite stripper to specifically identify the stripper, e.g. heavy-duty versus medium-duty stripping forces, as well as to suit safety requirements, e.g. orange-colored tip portion. In addition, various logos and/or part numbers may be molded into the end face portion 44 prior to the insert molding process.

The composite stripper of the present invention allows for closer joining or piercing center distances than steel spring stripper assemblies with comparable forces. Moreover, the overall size of composite stripper 36 is smaller than conventional steel spring stripper which require larger encasements for constraining the coil spring. One skilled in the art will readily recognize that the overall length and effective compliance of composite stripper 36 is dictated by the particular apparatus, the joining process and the desired clamping forces. As such, the specific materials and the hardness of such materials associated with a composite stripper may be modified without deviating from the spirit and scope of the present invention. In this regard, a urethane polymer is the presently preferred material, however other suitable plastics which provide the desired durability, wear, compliance and hardness characteristics may be substitute, and thus are considered within the scope of the present invention. Furthermore, one skilled in the art will readily recognize that the specific spring force generated by composite stripper 36 is primarily dictated by the geometry, length and wall thickness, as well as the material selection of middle portion 42. In this regard, one skilled in the art will readily appreciate that the present invention contemplates the use of strippers having various cylindrical configurations as well as cones and various polyhedral configurations may be incorporated into the present invention, and thus are considered within the scope of the present invention.

The foregoing discloses and describes an exemplary embodiment of the present invention. One skilled in the art will readily recognize from such discussion, and from the accompanying drawings, that various changes, modifications and variations may be made therein without departing from the spirit and scope of the invention as defined in the following claims.

What is claimed is:

1. A composite stripper for use with a punch assembly comprising an elongated member having a longitudinal bore formed therethrough and for receiving a punch, said elongated member including a first axial portion, a second axial portion, and a third axial portion, wherein said first axial portion and said third axial portion are formed of a hard material relative to said second portion for resisting wear of said elongated member, and wherein said second axial portion is integrally formed between said first and third portions of a soft material relative to said first and third axial portions for generating a clamping force when said elongated member is compressed.

2. The composite stripper of claim 1 wherein said elongated member has a circular cross-section.

3. The composite stripper of claim 2 wherein said elongated member is an elongated right cylinder.

4. The composite stripper of claim 1 wherein said longitudinal bore formed through said second axial portion has a diameter which is less than said longitudinal bore formed through said first axial portion.

5. The composite stripper of claim 1 wherein at least one of said first axial portion, said second axial portion and said third axial portion has a distinct visual characteristic from the other of said first, second and third axial portion to identify a functional characteristic of said composite stripper.

6. The composite stripper of claim 1 wherein said first axial portion, said second axial portion and said third axial portion are formed of a plastic material.

7. The composite stripper of claim 6 wherein said elongated member is formed of a urethane plastic.

8. The composite stripper of claim 7 wherein said first and third axial portions are formed of a urethane plastic having a durometer of approximately 75D, and said second axial portion is formed of a urethane plastic having a durometer of approximately 95A.

9. A punch assembly for joining sheet material items comprising:

a punch holder including a body and a punch extending from said body and terminating at a punch tip; and a composite stripper having a longitudinal bore formed therethrough for receiving said punch, said composite stripper including a base portion disposed over said punch adjacent said body, a tip portion disposed over said punch adjacent said punch tip and a compliant middle portion integrally formed between said base portion and said tip portion of a soft material relative to said base portion and said tip portion for generating a clamping force when said composite stripper is compressed.

10. The punch assembly of claim 9 wherein said base portion and said tip portion are formed of a hard plastic material relative to said compliant middle portion.

11. The punch assembly of claim 10 wherein said composite stripper is formed of a urethane plastic.

12. The punch assembly of claim 11 wherein said base portion and said tip portion are formed of a urethane plastic having a durometer of approximately 75D, and said middle portion is formed of a urethane plastic having a durometer of approximately 95A.

13. The punch assembly of claim 9 wherein said base portion, said middle portion and said tip portion have a circular cross-section.

14. The punch assembly of claim 13 wherein said composite stripper is an elongated right cylinder.

15. The punch assembly of claim 9 wherein said longitudinal bore formed through said middle portion has a diameter which is less than said longitudinal bore formed through said base portion.

16. The punch assembly of claim 9 wherein said longitudinal bore formed through said tip portion has a diameter which is greater than a diameter of said punch tip and less than a diameter of said longitudinal bore formed through said middle portion.

17. The punch assembly of claim 9 wherein at least one of said base portion, said middle portion and said tip portion are color-coded to identify a characteristic of said composite stripper.

18. The punch assembly of claim 9 wherein said tip portion of said composite stripper extend axially beyond said punch tip when said composite stripper is in an uncompressed state.

19. The punch assembly of claim 9 wherein said punch is releasably secured to said body.

20. A punch assembly for joining sheet material items comprising:

a punch holder including a body and a punch extending from said body and terminating at a tip; and a cylindrical composite stripper having a longitudinal bore formed therethrough for receiving said punch such that said composite stripper is disposed over said punch, said composite stripper including a urethane base portion having a durometer of about 75D located adjacent said body, a urethane tip portion having a durometer of about 75D located adjacent said tip and an elongated urethane middle portion integrally formed between said base portion and said tip portion, said middle portion having a durometer of about 95A.

* * * * *

UNITED STATES PATENT AND TRADEMARK OFFICE

CERTIFICATE OF CORRECTION

PATENT NO. : 6,430,795 B1 
DATED : August 13, 2002
INVENTOR(S) : Edwin G. Sawdon and Steven J. Sprotberry It is certified that error appears in the above-identified patent and that said Letters Patent is hereby corrected as shown below:

Column 2,
Line 30, "1.;" should be -- 1; --.
Line 41, "received" should be -- receive --.
Line 45, "received" should be -- receive --.

Column 4,
Line 1, "substitute" should be -- substituted --.

Column 6,
Line 6, "extend" should be -- extends --.

Signed and Sealed this

Eleventh Day of February, 2003

JAMES E. ROGAN
*Director of the United States Patent and Trademark Office*